US008439078B2

(12) United States Patent
Eklund

(10) Patent No.: US 8,439,078 B2
(45) Date of Patent: May 14, 2013

(54) ODOUR TRAP

(75) Inventor: Conny Eklund, Lonsboda (SE)

(73) Assignee: Purus AB, Sjobo (SE)

( * ) Notice: Subject to any disclaimer, the term of this patent is extended or adjusted under 35 U.S.C. 154(b) by 575 days.

(21) Appl. No.: 12/671,373

(22) PCT Filed: Jul. 8, 2008

(86) PCT No.: PCT/SE2008/050852

§ 371 (c)(1),
(2), (4) Date: Apr. 19, 2010

(87) PCT Pub. No.: WO2009/017449

PCT Pub. Date: Feb. 5, 2009

(65) Prior Publication Data

US 2010/0243074 A1 Sep. 30, 2010

(30) Foreign Application Priority Data

Aug. 1, 2007 (SE) ..... 0701803

(51) Int. Cl.
*F16K 15/16* (2006.01)

(52) U.S. Cl.
USPC ..... 137/855

(58) Field of Classification Search ..... 137/855, 137/856, 512.3, 853, 362
See application file for complete search history.

(56) References Cited

U.S. PATENT DOCUMENTS

| | | | | |
|---|---|---|---|---|
| 803,979 | A | 11/1905 | Bonnell | |
| 3,589,392 | A * | 6/1971 | Meyer | 137/846 |
| 4,870,992 | A | 10/1989 | Irwin et al. | |

FOREIGN PATENT DOCUMENTS

| | | |
|---|---|---|
| EP | 1244882 | 12/2000 |
| EP | 1 577 450 A1 | 9/2005 |
| JP | 2001-123488 A | 5/2008 |

* cited by examiner

*Primary Examiner* — Kevin Lee
*Assistant Examiner* — Macade Brown
(74) *Attorney, Agent, or Firm* — Tarolli, Sundheim, Covell & Tummino LLP

(57) ABSTRACT

The present invention relates to an odor trap intended for installing in a pipe to a drain. The odor trap comprises a tubular element (1) and a blocking means (2). The blocking means (2) makes it possible to close the pipe but is shiftable by fluid flowing in the odor trap in order to allow said fluid to pass, and in order, when the fluid has passed, to return to the position which closes the pipe. To achieve an odor trap in which the blocking means is well protected against undesirable external influences and the configuration of the odor trap is such that it is easy to fit, the tubular element (1) is made of inelastic material and the separate blocking means (2) disposed in the tubular element is made of elastically deformable material, said blocking means comprising a fitting portion (6) removably connected to a fitting portion (7) of the tubular element, and a blocking portion (8) which is integral via a peripheral edge (9) with the fitting portion of the blocking means, and which, when in the position which closes the flow cross-section of the pipe, abuts, via the peripheral edge, fluidtightly against the inside of the tubular element and which, possibly with parts of the fitting portion of the blocking means, is to a varying degree shiftable by the fluid to allow the fluid to pass.

30 Claims, 4 Drawing Sheets

ODOUR TRAP

BACKGROUND TO THE INVENTION

The present invention relates to an odour trap intended for installing in a pipe to a drain, which odour trap comprises a substantially tubular element which has substantially the same shape and size of flow cross-section as the pipe to the drain, and a blocking means, which blocking means, after the installing of the odour trap in the pipe, for closing the flow cross-section of the pipe to prevent fluid, preferably gas, from passing upwards in the pipe past the odour trap, runs in the flow direction downwards in the pipe from a first longitudinal wall section of the tubular element to a corresponding second longitudinal wall section thereof, which blocking means is at least partly shiftable by fluid, preferably liquid, flowing in the odour trap, in order, initially at the lowest portion of the blocking means in the flow direction, to allow the fluid, preferably liquid, to pass down downwards in the pipe past the odour trap and in order, when the fluid, preferably liquid, has passed, to return to the position which closes the flow cross-section of the pipe.

An odour trap as above is substantially previously known from U.S. Pat. No. 4,870,992 A, which discloses and describes two odour trap versions with completely different configurations and functions. The one version comprises a blocking means without a tubular element and the other a blocking means with a tubular element, in which the blocking means and the tubular element are integral. In both versions the odour trap is made of an elastically deformable material.

An odour trap of the kind indicated in the introduction is also previously known from SE 526 363 C2, in which, here again, the odour trap is integral and made of an elastically deformable material.

A problem with these known odour trap versions is, inter alia, that the active means, the blocking means, is very sensitive to external influences and that odour traps made of elastic material are difficult to fit.

BRIEF DESCRIPTION OF THE INVENTION

An object of the present invention is therefore to propose an odour trap in which the blocking means is well protected from undesirable external influences and the configuration of the odour trap is such that it is easy to fit.

The odour trap according to the present invention is thus characterized in that the tubular element of the odour trap is made of inelastic material and the separate blocking means disposed in the tubular element is made of elastically deformable material, that the blocking means comprises a fitting portion removably connected to a fitting portion of the tubular element, and comprises a blocking portion, that the blocking portion of the blocking means is integral, via a peripheral edge, along the whole of its contour with the fitting portion of the blocking means, that when in the position which closes the flow cross-section of the pipe the blocking portion abuts via the peripheral edge fluidtightly, preferably gastightly, against the inside of the tubular element, and that, depending on the flow of fluid, preferably liquid, downwards in the pipe past the odour trap, the blocking portion and possibly parts of the fitting portion of the blocking means are to a varying degree shiftable by the fluid, preferably liquid, towards said first longitudinal wall section of the tubular element to allow the fluid, preferably liquid, to pass between the peripheral edge of the blocking portion and the inside of the tubular element and between the outside of any shifted parts of the fitting portion of the blocking means and the inside of the tubular element.

This version of the odour trap keeps the blocking means of the odour trap well protected against external influences while at the same time making the blocking means easy to fit in the tubular element.

Other objects and advantages of the invention will be apparent to one skilled in the art who examines the attached drawings and the following detailed description of preferred embodiments.

DETAILED DESCRIPTION OF PREFERRED EMBODIMENTS OF THE INVENTION

Figure 1:
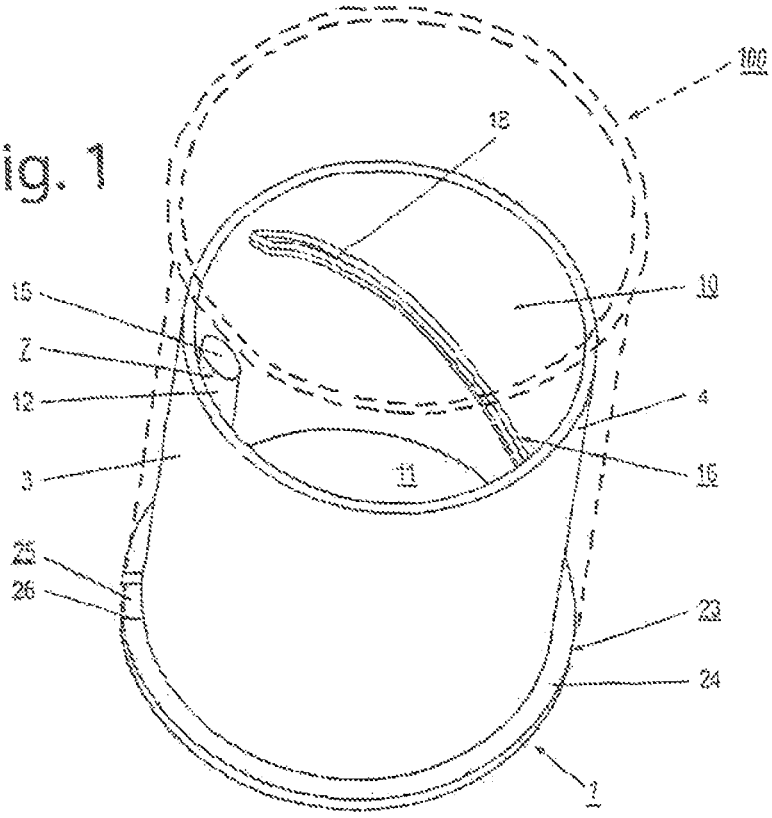
FIGS. 1 and 2 are views in perspective of a first version of a tubular element which forms part of the odour trap according to the present invention.

The odour trap according to the present invention is intended to be installed in a pipe 100 to a drain.

The odour trap comprises a substantially tubular element 1 which has substantially the same shape and size of flow cross-section as the pipe to the drain, and a blocking means 2.

As such, the odour trap is conventionally configured so that after being installed in the pipe it assumes a first position to close the flow cross-section of the pipe in order to prevent fluid, preferably gas, from passing upwards in the pipe past the odour trap. To this end, the blocking means 2 of the odour trap runs in the flow direction downwards in the pipe from a first longitudinal wall section 3 of the tubular element 1 to a corresponding second longitudinal wall section 4 thereof.

The odour trap is also movable to a second position, i.e. the blocking means 2 is at least partly shiftable by fluid, preferably liquid, flowing in the odour trap, in order, initially at the lowest portion 5 of the blocking means in the flow direction, to allow the fluid, preferably liquid, to pass downwards in the pipe past the odour trap. When the fluid, preferably liquid, has passed, the blocking means 2 reverts to the position which closes the flow cross-section of the pipe, i.e. said first position.

The tubular element 1 of the odour trap according to the invention is made of inelastic material, whereas the separate blocking means 2 disposed in the tubular element is made of elastically deformable material. The fact that the tubular element 1 is made of inelastic material means that it is durable and affords optimum protection to the elastic blocking means.

The blocking means 2 comprises a fitting portion 6 which, when the blocking means is applied to the tubular element 1, is connected removably to a fitting portion 7 of the tubular element. The blocking means 2 also comprises a blocking portion 8 for closing the flow cross-section of the pipe 100. Via a peripheral edge 9, the blocking portion 8 is integral along the whole of its contour with the fitting portion 6. Via this peripheral edge 9 the blocking portion 8 in the closed state abuts fluidtightly, preferably gastightly, against the inside of the tubular element 1.

Depending on the flow of fluid, preferably liquid, downwards in the pipe past the odour trap, the blocking portion 8 and possibly parts of the fitting portion 6 of the blocking means 2 which, as already indicated, is integral with the blocking portion are, owing to their elasticity, shiftable to a varying degree by the fluid, preferably liquid, towards said first longitudinal wall section 3 of the tubular element 1 to allow the fluid, preferably liquid, to pass between the peripheral edge 9 of the blocking portion and the inside of the tubular element and between the outside of any shifted parts of the fitting portion of the blocking means and the inside of the tubular element. The greater the flow, the more the blocking portion 8, initially at the lowest portion 5, and thereafter possibly also said parts of the fitting portion 6 of the blocking means are pushed away from opposite portions of the inside of the tubular element 1. During powerful flow, the blocking portion 8 and possibly said parts of the fitting portion 6 of the blocking means 2 are shiftable in the manner indicated by the fluid, preferably liquid, to such an extent that substantially the whole of the flow cross-section of the pipe becomes free. The material and material thickness of the blocking means 2 are chosen with a view to said shifting and the return to the closed state taking place in an optimum manner. For effective diversion of fluid, preferably liquid, and effective shifting of, above all, the blocking portion 8 of the blocking means 2, the blocking portion constitutes when so shifted a channel running in the flow direction of the fluid, preferably liquid.

In the versions depicted in the drawings, the tubular element 1 is substantially circular, since conventional drains are usually circular. Consequently, along its sloping configuration, the blocking portion 8 of the blocking means 2 is substantially oval, with the longer axis of the oval running in the flow direction downwards in the pipe from said first longitudinal wall section 3 of the tubular element to said opposite second longitudinal wall section 4 thereof. In the versions depicted in the drawings, the longer axis of the oval of the blocking portion 8 of the blocking means 2 also runs in the flow direction downwards in the pipe from the vicinity of the inlet aperture 10 of the tubular element 1 to the vicinity of the outlet aperture 11 of the tubular element.

The tubular element 1 and the fitting portions 6, 7 of the blocking means 2 may be configured in various ways to achieve equivalent functions.

Thus the fitting portion 7 of the tubular element 1 may, as in the versions depicted in the drawings, take the form of a spigot 12 which runs in the longitudinal direction of the tubular element and onto which the fitting portion 6 of the blocking means 2 can be slipped. The spigot 12 extends with advantage along substantially the whole length of the tubular element 1. The spigot 12 is disposed at said first longitudinal wall section 3 of the tubular element 1, i.e. the wall section from which the blocking means 2 runs downwards in the flow direction towards the opposite longitudinal wall section 4.

Figure 2:
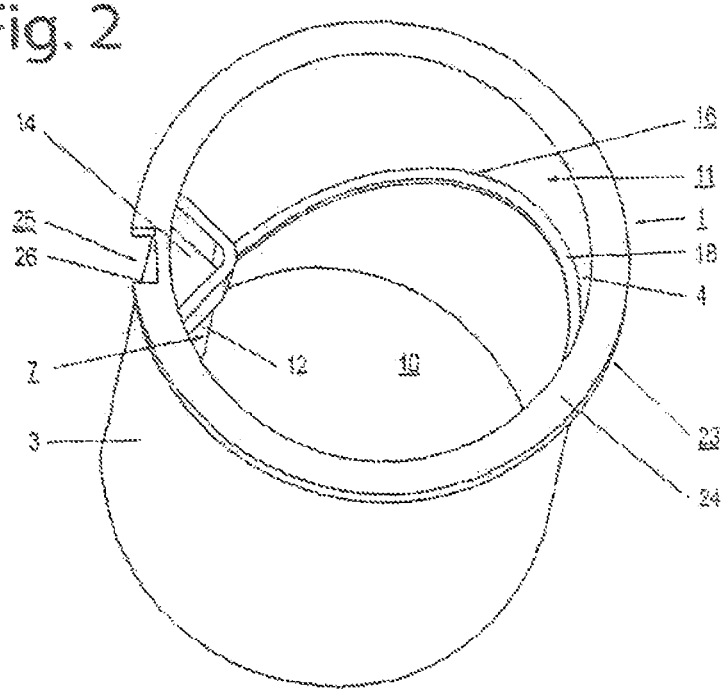
Figure 3:
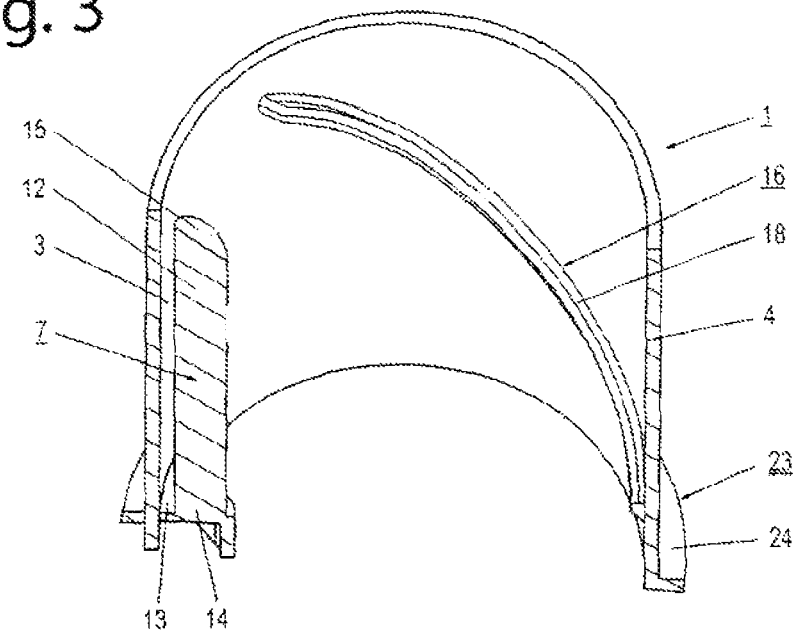
FIG. 3 illustrates the tubular element according to FIGS. 1 and 2 in a cutaway view.
Figure 4:
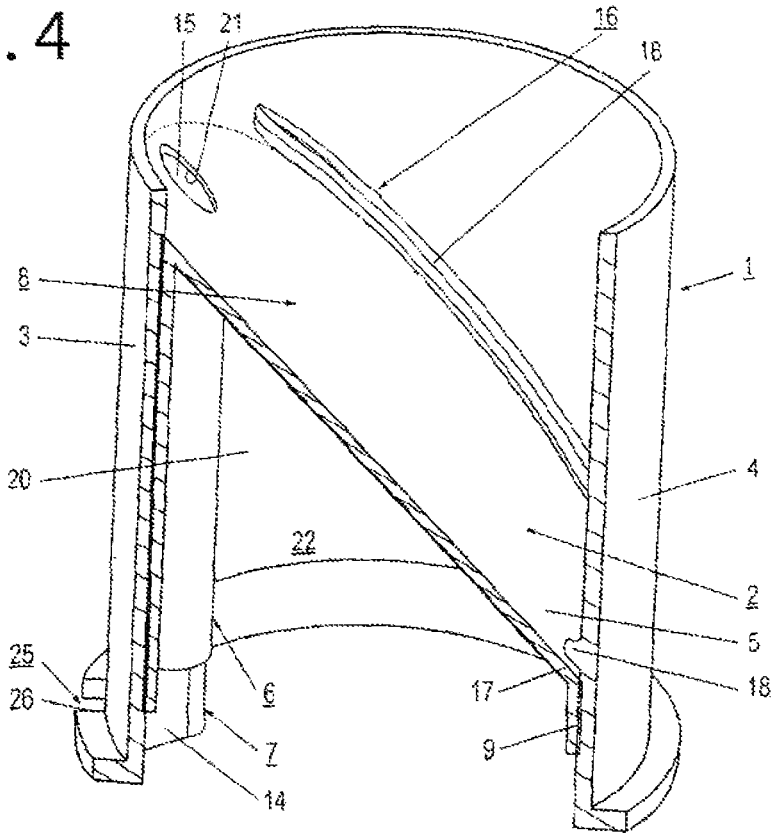
FIG. 4 depicts in a cutaway view the tubular element with blocking means disposed therein, in a closed state.
Figure 5:
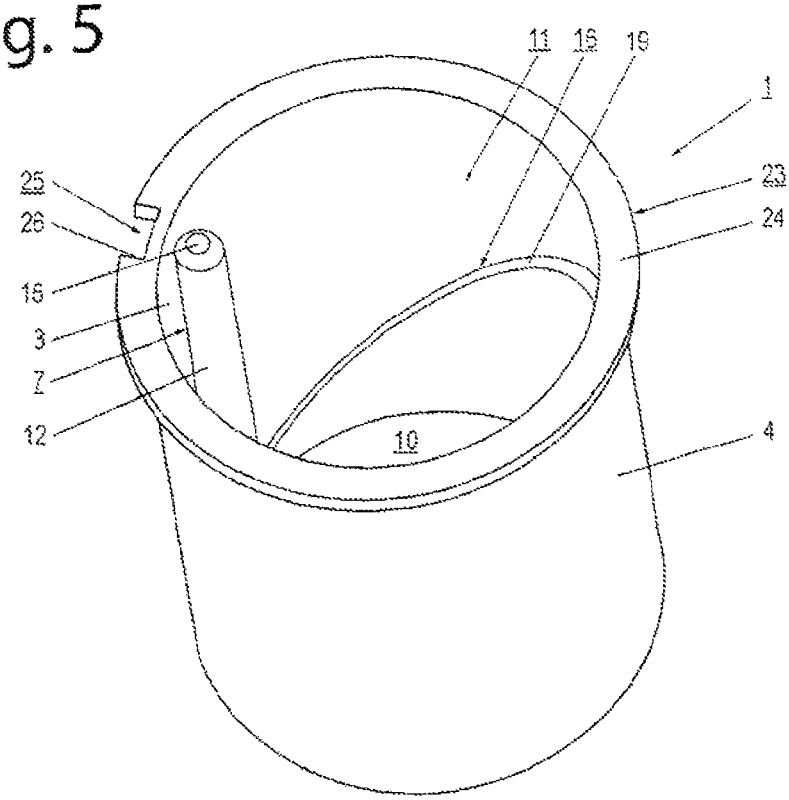
FIGS. 5 and 6 are perspective views of a second version of a tubular element which forms part of the odour trap according to the present invention.
Figure 6:
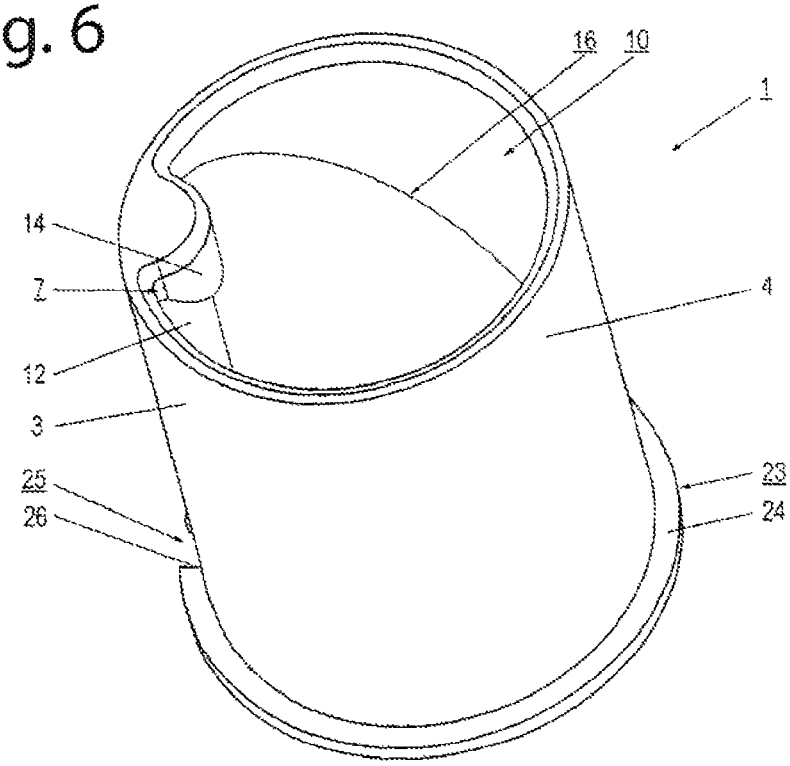
Figure 7:
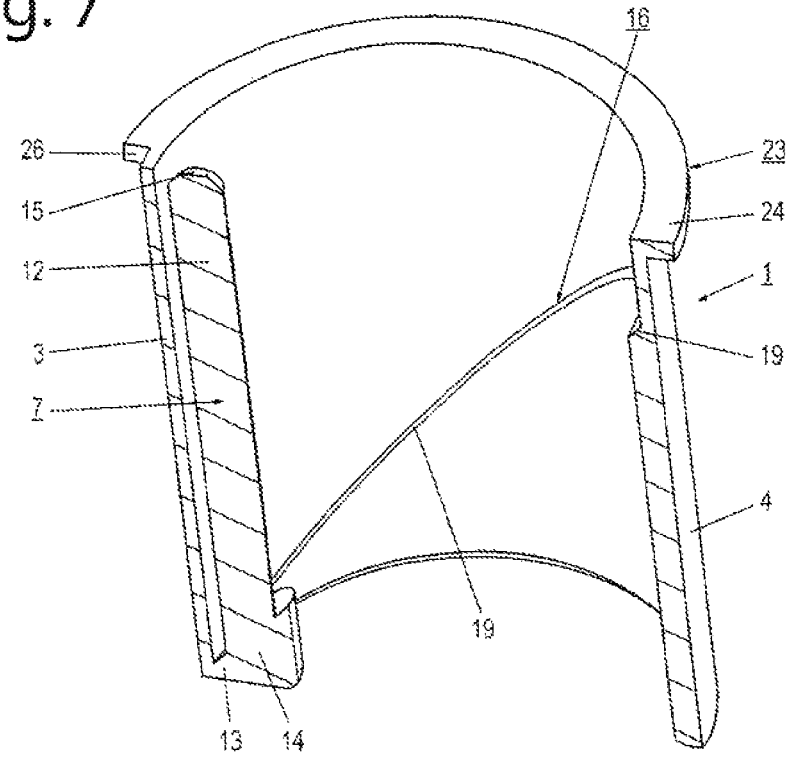
FIG. 7 illustrates the tubular element according to FIGS. 5 and 6 in a cutaway view.
Figure 8:
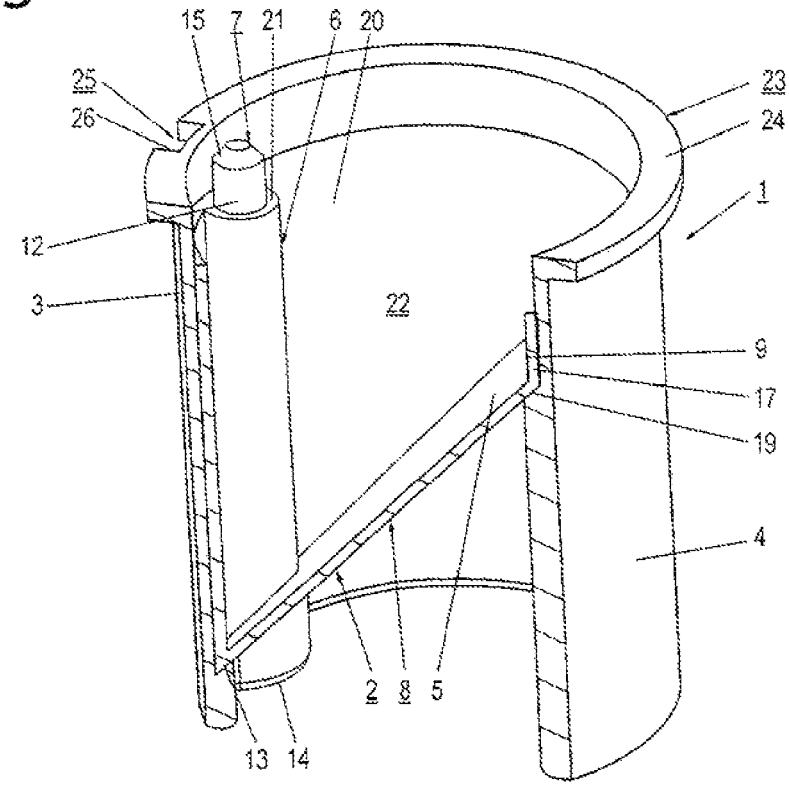
FIG. 8 depicts in a cutaway view the tubular element according to FIGS. 5-7 with blocking means disposed therein, in a closed state.

At one end of the spigot 12 there is a stop 13 for limiting the insertion of the blocking means 2 into the tubular element 1. In the version according to FIGS. 1-4 this stop 13 is situated at the end 14 of the spigot 12 which is situated, as viewed in the flow direction, in the vicinity of the outlet aperture 11 of the tubular element 1. In the version according to FIGS. 5-8, the stop 13 is situated instead at the end of the spigot 12 which is situated, as viewed in the flow direction, in the vicinity of the inlet aperture 10 to the tubular element 1, i.e. the stop end 14 is here situated at the inlet aperture.

To further enhance the sealing effect of the blocking means 2, the tubular element 1 has with advantage on the inside an abutment portion 16 against which the blocking portion 8 of the blocking means abuts via an edge portion 17 when in the position which closes the flow cross-section of the pipe 100. The abutment takes place from below as viewed in the flow direction, i.e. in the opposite direction to the flow direction, in order to facilitate the shifting of the blocking portion.

The abutment portion 16 runs in the flow direction downwards in the pipe from the first longitudinal wall section 3 of the tubular element 1 to the opposite longitudinal wall section 4 thereof, i.e. it has the same configuration as the blocking portion 8 so that the blocking portion abuts against it along the whole of its contour. In the version according to FIGS. 1-4 the abutment portion 16 thus runs from the vicinity of the end 15 of the spigot which is opposite to the stop end of the spigot 12, whereas the abutment portion in the version according to FIGS. 5-8 runs from the stop end 14 of the spigot 12.

The abutment portion 16 may be configured in any manner appropriate to the purpose. Thus the abutment portion 16 may, as in FIGS. 1-4, be configured as a flange 18 or, as in FIGS. 5-8, as a recess 19 in the material of the tubular element 1.

The fitting portion 7 of the tubular element 1, i.e. in the versions depicted the spigot 12 with the stop 13, and the abutment portion 16 in the version according to FIGS. 1-4, i.e. the flange 18, lock the blocking means 2 against movement in both directions in the longitudinal direction of the tubular element.

The fitting portion 6 of the blocking means 2 takes the form in the versions depicted in the drawings of a wall section 20 which is substantially tubular in the lower portion as viewed in the flow direction, abuts sealingly against the inside of the tubular element 1 and has a duct 21 running in the longitudinal direction of the tubular element and intended for slipping onto the spigot 12. The duct 21 runs along substantially the whole length of the fitting portion 6.

The fitting portion 6 of the blocking means 2 and the latter's blocking portion 8 which delineates the blocking means upwards also jointly constitute a check valve means in the form of a space 22 which is open downwards as viewed in the flow direction. When fluid, preferably liquid, flows upwards in the pipe 100 towards the odour trap, the fluid, preferably liquid, is pushed into the space 22. Said portions 6, 8 are thereby pressed against the inside of the tubular element 1 and tightness is achieved. The greater the upward flow, the greater the sealing force generated.

The fitting portion 6 of the blocking means 2 and the latter's blocking portion 8 which delineates the blocking means upwards also jointly constitute a check valve means in the form of a space 22 which is open downwards as viewed in the flow direction. When fluid, preferably liquid, flows upwards in the pipe towards the odour trap, the fluid, preferably liquid, is pushed into the space 22. Said portions 6, 8 are thereby pressed against the inside of the tubular element 1 and tightness is achieved. The greater the upward flow, the greater the sealing force generated.

The tubular element 1 has at least one fitting means 23 for removably fitting the odour trap in the pipe to the drain. The fitting means 23 is preferably integral with the tubular element 1.

The fitting means, in the versions depicted in the drawings a fitting and sealing flange 24, may be configured on the tubular element 1 at or in the vicinity of the inlet aperture 10 thereto, for fitting in an inlet end of the pipe. In the versions depicted, however, the fitting and sealing flange 24 is configured at or in the vicinity of the outlet aperture 11 of the tubular element 1. These versions are intended for fitting in an outlet end of the pipe.

The tubular element 1 further has at least one guide means 25 for cooperation with a corresponding guide means (not depicted) on the pipe.

In the versions depicted in the drawings the guide means 25 on the tubular element 1 takes the form of a recess 26 in the latter's fitting and sealing flange 24, in which recess a guide means in the form of, for example, a guide spigot on the pipe 100 is inserted during the fitting of the odour trap in said pipe.

The blocking means 2 may be made of natural rubber or some thermal plastic elastomer. The blocking means 2 may also be made of nitrile rubber, preferably chlorinated nitrile rubber, so that the blocking means causes as little friction as possible and hence all of the fluid, preferably liquid, can run away. Inorganic polymers such as silicone are also usable.

The odour trap according to the present invention may also be fitted in a horizontal pipe. In the case of horizontal fitting, the blocking portion 8 has to be situated in such a way that it also runs from above and downwards in a horizontal direction.

It will be obvious to one skilled in the art that the odour trap according to the present invention can be modified and altered within the scope of the claims set out below without departing from the idea and objects of the invention. Thus the tubular element 1 of the odour trap may be quite other than circular with a quite other than circular flow surface and the blocking portion 8 of the blocking means 2 may consequently also be other than oval in shape. The length of the tubular element 1 may vary as necessary and desired, but has to be at least such that the blocking means 2 in its entirety is protected by the tubular element 1. The slope of the blocking portion 8 of the blocking means 2 may also vary as necessary and desired. The greater the slope, the easier the shifting of the blocking portion 8 and the easier the diversion of fluid, preferably liquid. In addition to what is indicated above, the choice and thickness of material of the constituent parts 1, 2 of the odour trap may also vary.

The invention claimed :

1. An odour trap intended for installing in a pipe to a drain, the odour trap comprising:

a substantially tubular element (1) which has substantially the same shape and size of flow cross-section as the pipe to the drain, and a blocking means (2), the blocking means (2), after the installing of the odour trap in the pipe, for closing the flow cross-section of the pipe to prevent gas from passing upwards in the pipe past the odour trap, runs in the flow direction downwards in the pipe from a first longitudinal wall section (3) of the tubular element to a second longitudinal wall section (4) thereof located opposite to said first longitudinal wall sections (3), wherein the blocking means (2) is at least partly shiftable by liquid flowing in the odour trap to, initially at a lowest portion (5) of the blocking means in the flow direction, allow the liquid to pass downwards in the pipe past the odour trap and to, when the liquid has passed, return to the position which closes the flow cross-section of the pipe, wherein the tubular element (1) of the odour trap is made of inelastic material and the blocking means (2) disposed in the tubular element is made of elastically deformable material, the blocking means (2) comprising a blocking portions (8) and a fitting portion (6) removably connected to a fitting portion (7) of the tubular element (1), the fitting portion (7) of the tubular element (1) consisting a spigot (12) in the longitudinal direction of the tubular element (1), the fitting portion (6) of the blocking means (2) constituting a wall section (20) which abuts sealingly against the inside of the tubular element (1), is substantially tubular in the lower portion as viewed in the flow direction, and is provided with a duct (21) running in the longitudinal direction of the tubular element (1) and intended for slipping onto the spigot (12), the blocking portion (8) of the blocking means (2) being integral along the whole of its contour, via a peripheral edge (9), with the fitting portion (6) of the blocking means, wherein when in the position which closes the flow cross-section of the pipe the blocking portion (8) abuts via the peripheral edge (9) gastightly against the inside of the tubular element (1), and wherein depending on the flow of liquid downwards in the pipe past the odour trap, at least one of the blocking portion (8) and the fitting portion (6) of the blocking means (2) is to a varying degree shiftable by the liquid towards said first longitudinal wall section (3) of the tubular element (1) to allow the liquid to pass between the peripheral edge (9) of the blocking portion and the inside of the tubular element and between an outside of any shifted parts of the fitting portion of the blocking means and the inside of the tubular element.

2. An odour trap according to claim 1, wherein at least one of the blocking portion (8) and the fitting portion (6) of the blocking means (2) is shiftable by the liquid towards said first longitudinal wall section (3) of the tubular element (1) so that substantially the entire flow cross-section of the pipe becomes free.

3. An odour trap according to claim 1, wherein depending on the flow of liquid downwards in the pipe past the odour trap, the blocking portion (8) constitutes when so shifted a channel running in the flow direction of the liquid.

4. An odour trap according to claim 1, wherein the tubular element (1) is substantially circular and the blocking portion (8) of the blocking means (2) is substantially oval, with a longer axis of the oval running in the flow direction downwards in the pipe from said first longitudinal wall section (3) of the tubular element to said opposite second longitudinal wall section (4) thereof.

5. An odour trap according to claim 4, wherein the longer axis of the oval runs in the flow direction downwards in the pipe from the vicinity of an inlet aperture (10) of the tubular element (1) to the vicinity of an outlet aperture (11) of the tubular element.

6. An odour trap according to claim 1, wherein the spigot (12) extends along substantially all of the length of the tubular element (1).

7. An odour trap according to claim 1, wherein the spigot (12) is disposed at said first longitudinal wall section (3) of the tubular element (1).

8. An odour trap according to claim 1, wherein one end (14 or 15) of the spigot (12) has a stop (13) for limiting the insertion of the blocking means (2) into the tubular element (1).

9. An odour trap according to claim 8, wherein the end (14) of the spigot (12) has the stop (13) situated, as viewed in the flow direction, in the vicinity of an outlet aperture (11) to the tubular element (1).

10. An odour trap according to claim 8, wherein the end (14) of the spigot (12) has the stop (13) situated, as viewed in the flow direction, in the vicinity of an inlet aperture (10) to the tubular element (1).

11. An odour trap according to claim 1, wherein the tubular element (1) has on the inside an abutment portion (16) against which an edge portion (17) of the blocking portion (8) of the blocking means (2) abuts from below, as viewed in the flow direction, when the blocking portion (8) is in the position which closes the flow cross-section of the pipe.

12. An odour trap according to claim 11, wherein the abutment portion (16) runs in the flow direction downwards in the pipe from said first longitudinal wall section (3) of the tubular element (1) to the opposite second longitudinal wall section (4) thereof.

13. An odour trap according to claim 12, wherein from an vicinity of the end (15) of the spigot (12) opposite a stop end (14) the abutment portion (16) runs in the flow direction downwards in the pipe from said first longitudinal wall section (3) of the tubular element (1) to the opposite second longitudinal wall section (4) thereof.

14. An odour trap according to claim 12, wherein from a stop end (14) of the spigot (12) the abutment portion (16) runs in the flow direction downwards in the pipe from said first longitudinal wall section (3) of the tubular element (1) to the opposite second longitudinal wall section (4) thereof.

15. An odour trap according to claim 1, wherein the fitting portion (7) and abutment portion (16) of the tubular element (1) jointly constitute a locking means which prevents movement of the blocking means (2) in the longitudinal direction of the tubular element.

16. An odour trap according to claim 11, wherein the abutment portion (16) takes the form of a flange (18).

17. An odour trap according to claim 11, wherein the abutment portion (16) takes the form of a recess (19) in the material of the tubular element (1).

18. An odour trap according to claim 1, wherein the duct (21) extends along substantially all of the length of the fitting portion (6).

19. An odour trap according to claim 1, wherein the fitting portion (6) of the blocking means (2) constitutes a return means for returning the blocking portion (8) to abutment against the inside of the tubular element (1), the return force of the return means varying depending on the extent to which the blocking portion and any shifted parts of the fitting portion of the blocking portion have been shifted by the flow of liquid downwards in the pipe past the odour trap.

20. An odour trap according to claim 1, wherein the fitting portion (6) and blocking portion (8) of the blocking means (2) jointly constitute a check valve means in the form of a space (22) which is open downwards, as viewed in the flow direction, said check valve means being ,during flow of liquid upwards in the pipe, pressed against the inside of the tubular element (1) by said flow.

21. An odour trap according to claim 1, wherein the tubular element (1) has at least one fitting means (23) for removable fitting of the odour trap in the pipe to the drain.

22. An odour trap according to claim 21, wherein the fitting means (23) is integral with the tubular element (1).

23. An odour trap according to claim 21, wherein the fitting means (23) is configured on the tubular element (1) at or in the vicinity of an inlet aperture (10) thereto for fitting the odour trap in an inlet end of the pipe.

24. An odour trap according to claim 21, wherein the fitting means (23), is configured on the tubular element (1) at or in the vicinity of an outlet aperture (11) thereto for fitting the odour trap in an outlet end of the pipe.

25. An odour trap according to claim 1, wherein the tubular element (1) has at least one guide means (25) for cooperation with a corresponding guide means on the pipe.

26. An odour trap according to claim 25, wherein the guide means (25) on the tubular element (1) takes the form of a recess (26) in a fitting and sealing flange (24) of said tubular element, into which recess a guide means in the form of a guide spigot on the pipe is inserted during the fitting of the odour trap in said pipe.

27. An odour trap according to claim 1, wherein the blocking means (2) is made of natural rubber.

28. An odour trap according to claim 1, wherein the blocking means (2) is made of nitrile rubber.

29. An odour trap according to claim 1, wherein the blocking means (2) is made of a thermoplastic elastomer.

30. An odour trap according to claim 1, wherein the blocking means (2) is made of an inorganic polymer.

* * * * *